US005420595A

United States Patent [19]

Zhang et al.

[11] Patent Number: 5,420,595

[45] Date of Patent: May 30, 1995

[54] MICROWAVE RADIATION SOURCE

[75] Inventors: Xi-Cheng Zhang, Latham; David H. Auston, New York, both of N.Y.

[73] Assignee: Columbia University in the City of New York, Morningside Heights, N.Y.

[21] Appl. No.: 144,724

[22] Filed: Oct. 28, 1993

Related U.S. Application Data

[63] Continuation of Ser. No. 846,831, Mar. 6, 1992, abandoned, which is a continuation-in-part of Ser. No. 664,798, Mar. 5, 1991, abandoned.

[51] Int. Cl.[6] ..... H01Q 3/22; H01Q 3/24; H01Q 1/06

[52] U.S. Cl. ..... 342/368; 343/721; 342/371

[58] Field of Search ..... 342/368, 371; 343/720, 343/721; 250/214.1; 257/21, 80, 439, 615

[56] References Cited

U.S. PATENT DOCUMENTS

| | | | |
|---|---|---|---|
| 3,222,601 | 12/1965 | Sartorio et al. | 343/762 |
| 3,631,360 | 12/1971 | Lehovek | 250/552 |
| 3,633,994 | 1/1972 | Carlson | 257/428 |
| 3,649,855 | 3/1972 | Auld | 310/334 |
| 4,855,749 | 8/1989 | DeFonzo | 343/767 |
| 4,866,660 | 9/1989 | Merkelo et al. | 364/822 |
| 5,014,069 | 5/1991 | Seiler et al. | 343/785 |
| 5,130,690 | 7/1992 | Ando et al. | 338/15 |

OTHER PUBLICATIONS

"Generation of Fermtosecond Electromagnetic Pulses From Semiconductor Surfaces", *Appl. Phys. Lett.* 56 (1990), pp. 1011–1013.

Hu et al, "Optically Steerable Photoconducting Antennas", Appl. Phy. Letters 56, 5 Mar. 1990, pp. 886–888.

Zhang et al, "Generation of Femtosecond Pulses Semiconductor Surfaces", Appl. Phy. Letters 56, 12 Mar. 1990 pp. 1011–1013.

*Primary Examiner*—Gregory C. Issing

*Attorney, Agent, or Firm*—Brumbaugh, Graves, Donohue & Raymond

[57] ABSTRACT

A source of collimated beam or beams of microwave electromagnetic radiation pulses comprises a photoconductor substrate having a major surface and an optical radiation source providing a beam of optical radiation pulses for illuminating at least a relatively large aperture region of the major surface. A static electric field, intrinsic or applied, is present at the major surface for driving transient photocurrents generated by the beam of optical radiation pulses. Each beam of microwave electromagnetic radiation pulses emitted from the photoconductor substrate may be steered by varying the angle of incidence of the beam of optical radiation pulses illuminating the major surface, by varying the period of the spatial variation of a static electric field applied to the major surface by means of electrodes, or by varying the period or direction of a periodic intensity variation of a spatially modulated beam of optical radiation pulses on the major surface.

36 Claims, 5 Drawing Sheets

MICROWAVE RADIATION SOURCE

The United States Government has a paid-up license to this invention pursuant to contracts F49620-88-C-0109 and N00014-86-K-0694 awarded by the U.S. Air Force Office of Scientific Research and the U.S. Office of Naval Research, respectively.

CROSS-REFERENCE TO RELATED APPLICATION

This application is a continuation of application Ser. No. 07/846,831, filed on Mar. 6, 1992 now abandoned, which is a continuation-in-part application of patent application Ser. No. 07/664,798, filed Mar. 5, 1991 by the same inventors and owned by the same assignee, now abandoned.

BACKGROUND OF THE INVENTION

The present invention relates to the generation of microwave electromagnetic radiation.

Sources of directional microwave electromagnetic radiation, and especially steerable sources of such radiation may be used, e.g., in communications and radar; in the former case, a directional beam may be steered for line-of-sight alignment, and in the latter, for rapid sweeping of a spatial angle. For these and similar applications, microwave electromagnetic radiation preferably has a frequency greater than approximately 3 gigahertz (i.e., a wavelength of less than 10 cm).

For the generation of such radiation, a variety of devices have been devised, with representative disclosures as follows:

- U.S. Pat. No. 3,899,428, issued Aug. 12, 1975 to D. H. Auston et al., disclosing a transducer of electromagnetic radiation comprising an electrically polarizable, typically pyroelectric medium;
- U.S. Pat. No. 4,329,686, issued May 11, 1982 to G. Mourou, disclosing the generation of microwave pulses by means of a laser-activated semiconductor switch in a waveguide cavity;
- U.S. Pat. No. 4,636,794, issued Jan. 13, 1987 to V.P. McGinn, disclosing a steerable microwave radiator antenna including a plurality of elements having directional radiation patterns, with directional characteristics resulting from superposition of radiation from optically controlled radiator elements;
- U.S. Pat. No. 4,684,952, issued Jan. No. 13, 1987 to R. E. Munson et al., disclosing a (passive) microwave reflector or "reflectarray" including microstrip antenna elements which may be formed by photolithographic processing of a metal layer on a dielectric substrate;
- U.S. Pat. No. 4,739,334, issued Apr. 19, 1988 to R. A. Soref, disclosing a phased-array antenna including a plurality of radiator elements producing phase-shifted radio signals in response to phase-shifted optical signals;
- U.S. Pat. No. 4,751,513, issued Jun. 14, 1988 to A. S. Daryoush et al., disclosing a microwave radiator antenna, with tuning of frequency response by means of a photosensitive element connected to a radiator element;
- U.S. Pat. No. 4,855,749, issued Aug. 8, 1989 to A. P. DeFonzo, disclosing a planar opto-electronic transducer including tapered slot-line antenna elements which are monolithically integrated on a silicon-on-sapphire substrate; and
- U.S. Pat. No. 4,864,312, issued Sep. 5, 1989 to J. P. Huignard et al., disclosing a microwave radiator antenna with beam scanning controlled by electro-optical modulators which define optical paths having different lengths.

In the field of such disclosures, namely of microwave electromagnetic radiation sources, the invention described in the following provides for a particularly advantageous and readily manufacturable device structure for producing and controlling the direction of collimated beams of microwave electromagnetic radiation pulses.

SUMMARY OF THE INVENTION

In accordance with an aspect of the invention, a source of one or more collimated beams of microwave electromagnetic radiation pulses includes a photoconductor having a major surface, and means for illuminating at least a relatively large aperture region of the major surface of the photoconductor with a beam of optical radiation pulses. Such illumination of the major surface of the photoconductor results in the emission of one or more collimated beams of microwave radiation pulses from the photoconductor.

In accordance with a preferred first embodiment of the invention, each emitted beam of microwave electromagnetic radiation can be steered by controlling the direction of incidence of optical radiation on the photoconductor surface. The photoconductor may include electrodes for applying an external static electric field either parallel or perpendicular to the major surface in the region illuminated by the optical radiation pulses.

In accordance with a preferred second embodiment, the photoconductor includes a multiplicity of regularly-spaced, linearly disposed electrodes formed on the major surface, and each beam of microwave radiation pulses emitted from the photoconductor can be steered by applying a suitable combination of voltages to these electrodes.

In accordance with a preferred third embodiment, the intensity of the beam of optical radiation pulses illuminating the major surface of the photoconductor has a periodic spatial modulation in a direction parallel to the major surface, and each emitted beam of microwave electromagnetic radiation pulses can be steered with two degrees of freedom by varying the periodic and/or the direction of the spatial modulation of the optical radiation pulses. The photoconductor may include appropriate electrodes or other means for providing a static electric field perpendicular to the major surface thereof.

DETAILED DESCRIPTION OF PREFERRED EMBODIMENTS

Figure 1:
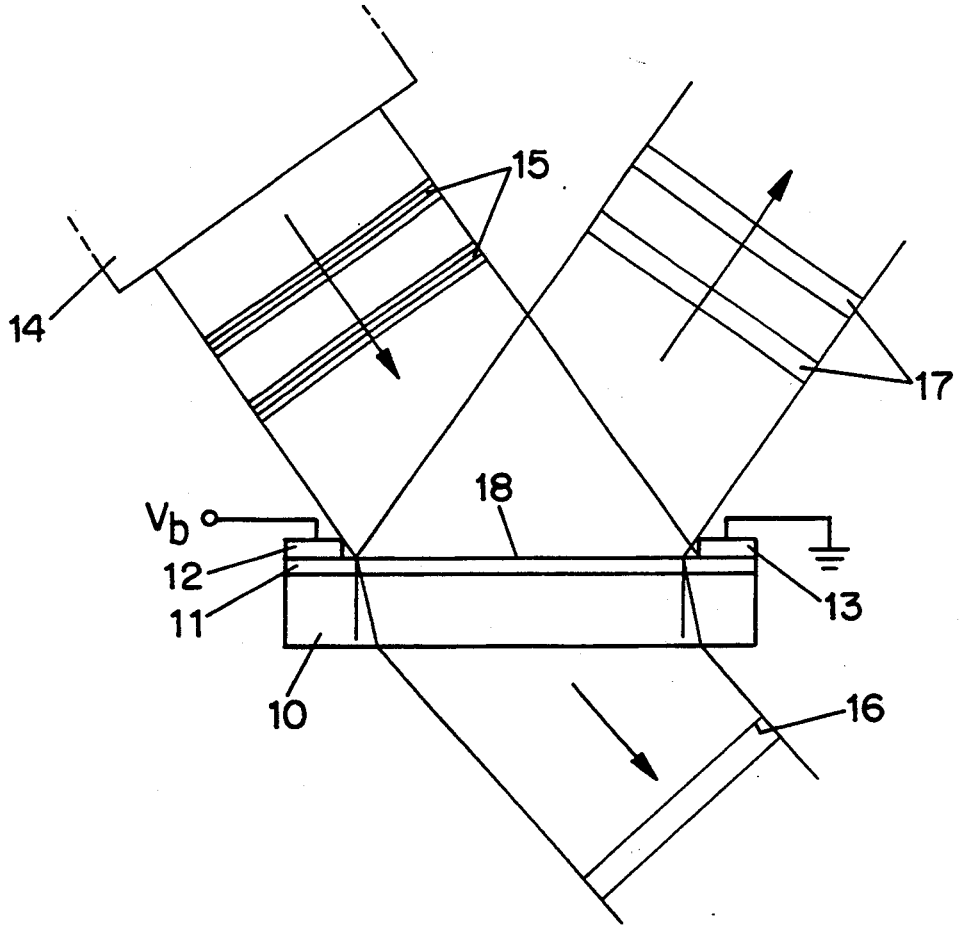
FIG. 1 is a schematic elevation of a microwave electromagnetic radiation source in accordance with a preferred first embodiment of the invention.

As shown in FIG. 1, a preferred first embodiment of the invention comprises a layer 11 of a photoconductor material on a substrate 10, e.g., a radiation-damaged epitaxial layer of silicon on a sapphire substrate, having a major surface 18. Alternatively, the photoconductor 11 may be self-supporting, such as an indium phosphide wafer. Formed on the major surface 18 of the photoconductor 11 are a pair of electrodes 12 and 13, which when connected to a d.c. voltage source $V_b$ and ground, respectively, provides a static electric field substantially parallel to the major surface 18 and extending into the photoconductor 11 adjacent the major surface 18. The electrodes 12 and 13 may be made, e.g., of a gold-germanium alloy by simultaneous deposition of evaporated gold and germanium, with a top layer of pure gold to facilitate wire bonding. Shown further is an optical radiation source 14 producing a train of optical pulses 15 which stimulate the emission of two beams of microwave electromagnetic radiation pulses 16 and 17. The optical radiation source 14 may be, for example, a balanced colliding-pulse mode-locked dye laser which produces a train of optical pulses having a repetition rate on the order of 100 MHz, a pulse duration less than 100 fs and an appropriate wavelength for generating electron-hole pairs in the photoconductor 11.

As used herein, the term "microwave electromagnetic radiation" shall mean electromagnetic radiation having a frequency in the range of 1 Ghz to 10 THz, and the term "optical radiation" shall mean electromagnetic radiation of a sufficiently high frequency to produce electron-hole pairs in the photoconductor material being used to generate the beams of microwave electromagnetic radiation. Furthermore, as referred to herein, an "optical radiation pulse" shall be understood to have a preferred pulse duration which is less than the shorter of the time required for a photogenerated electron-hole pair to traverse a region of surface electric field, or the lifetime of the photogenerated electron-hole pair. Use of such pulses is in the interest of generating microwave radiation having good directionality.

When a beam of (sub-picosecond) optical radiation pulses illuminates the region of the major surface 18 between electrodes 12 and 13, electron-hole pairs are generated in the photoconductor material beneath the major surface. The static electric field established by the electrodes 12 and 13, and the bias potential $V_b$ drives the two kinds of photogenerated carriers in opposite directions to produce a transient photocurrent flowing parallel to the major surface 18. Such a transient photocurrent has a rise time on the order of the duration of the optical radiation pulses and a fall time on the order of the transit time of the free carriers across the region of the subsurface static electric field (assuming that the lifetimes of the carriers are longer than their transit time). The transient photocurrent produced by each pulse of the optical radiation radiates a forward pulse 16 and a backward pulse 17 of microwave electromagnetic radiation having a pulse duration comparable to that of the optical radiation pulse 15, a bandwidth of greater than 1 THz and a wavelength at the peak of its frequency spectrum in the submillimeter wave range.

In the far field, the amplitude of each of the microwave electromagnetic radiation pulses 16 and 17 is proportional to the first time derivative of the transient photocurrent radiating the pulses. If the dimensions of the total illuminated area of the major surface 18 between the electrodes 12 and 13 are greater than the wavelength of the peak of the frequency spectrum of the microwave electromagnetic radiation pulses, such pulses are radiated in directional beams 16 and 17, which are collimated to the diffraction limit. The region of the major surface 18 which is illuminated by the optical radiation pulses 15 and beneath which there exists an electric field for accelerating photogenerated carriers to cause the radiation of the forward and backward beams of microwave electromagnetic radiation pulses 16 and 17, is referred to herein as the "aperture" of the microwave radiation source.

An advantageous feature of a microwave electromagnetic radiation source according to the invention is that the forward and backward beams of microwave electromagnetic radiation pulses 16 and 17 are emitted from a relatively large aperture so that the diffraction affects on the emitted beams 16 and 17 are small. Consequently, the emitted beams of microwave electromagnetic radiation pulses 16 and 17 are not only directional but also have a high degree of collimation (i.e., a low degree of beam divergence).

To achieve a relatively large aperture in the configuration of FIG. 1, where the electric field driving the photogenerated carriers is produced by electrodes 12 and 13 formed on the major surface 18 of the photoconductor 11, the spacing of the electrodes 12 and 13 should be significantly greater than the wavelength of the peak of the frequency spectrum of the emitted microwave electromagnetic radiation pulse. For example, where the emitted microwave electromagnetic radiation pulses have a frequency spectrum which peaks at approximately 500 microns, electrode spacings from 2 to 10 millimeters (i.e., 4 to 20 times the wavelength of the peak of the frequency spectrum of the microwave pulses) are advantageously used.

The angular relationship with respect to the normal of the major surface 18 between the direction of the beam of optical radiation pulses 15 incident on the major surface, and the forward and backward microwave electromagnetic radiation pulse beams 16 and 17, satisfy a generalized Fresnel law. For example, if the backward beam of the microwave electromagnetic radiation pulses 17 propagates into a non-dispersive medium, such as air, the direction of the backward beam 17 is the same as the direction of the specularly reflected optical radiation pulses.

Experiments were carried out with a number of photoconductor materials, namely radiation-damaged silicon (on a sapphire substrate), indium phosphide, gallium arsenide, polysilicon, and cadmium telluride. All these materials strongly absorb femtosecond laser pulses at a wavelength of 625 nanometers. In the absence of light, each of these materials exhibited a high electrical resistivity. A high electrical resistivity is particularly desirable where large electric fields and are to be applied to the photoconductor 11, e.g., a high $V_b$ applied to electrode 12. In the experiments, values of $V_b$ ranging from 100 to 3000 volts were used. Among the materials used in these experiments, indium phosphide was found to be the most sensitive in terms of the ratio of microwave radiation intensity to optical radiation intensity, with a sensitivity of approximately 9.8 times that of radiation-damaged silicon. The corresponding figures for sensitivity, relative to radiation-damaged silicon, are 7.5 for gallium arsenide, 0.2 for polysilicon, and 7.0 for cadmium telluride. Thus, Group III–V and Group II–VI compound-semiconductors are advantageous materials from the standpoint of the invention on account of the superior sensitivity of these materials.

In the experiments, the microwave electromagnetic radiation field was sensed with a photoconducting dipole probe of the type described by P. R. Smith et al., "Subpicosecond Photoconducting Dipole Antennas", *IEEE Journal of Quantum Electronics*, Vol. 24 (1988), pp. 255–260. The probe used consisted of a 100-micrometer dipole having a radiation-damaged silicon-on-sapphire photoconductor at its feed point. A 3-millimeter sapphire ball lens or fused quartz lens was placed over the dipole to improve its radiation collection efficiency. The small size and high speed of this detecting antenna permitted its use as a movable probe to measure the temporal as well as the spatial distribution of the microwave electromagnetic radiation field generated by the large-aperture photoconductor devices of the invention.

The source of the optical radiation pulses used in the experiments was a balanced, colliding-pulse, mode-locked Rhodamine 6G dye laser of the type described by J. A. Valdmanis et al., "Generation of Optical Pulses as Short as 27 Femtoseconds Directly from a Laser Balancing Self-phase Modulation, Group-velocity Dispersion, Saturable Absorption, and Saturable Gain", *Optics Letters*, Vol. 10 (1985), pp 131–133. The optical radiation pulses produced by the laser had a pulse duration of approximately 75 femtoseconds, a wavelength of approximately 625 nanometers and an average power incident on the photoconductor surface 18 of approximately 10 milliwatts. A portion of the output of the laser was diverted by means of a beam splitter and used as a probe beam for triggering the photoconducting dipole probe. The average power of this probe beam was approximately 5 milliwatts. The optical radiation pulse beam illuminating the photoconductor surface 18 was defocused to uniformly illuminate the relatively large aperture, and had a Gaussian profile with a 1/e diameter approximately equal to the spacing of the electrodes 12 and 13.

Figure 3:
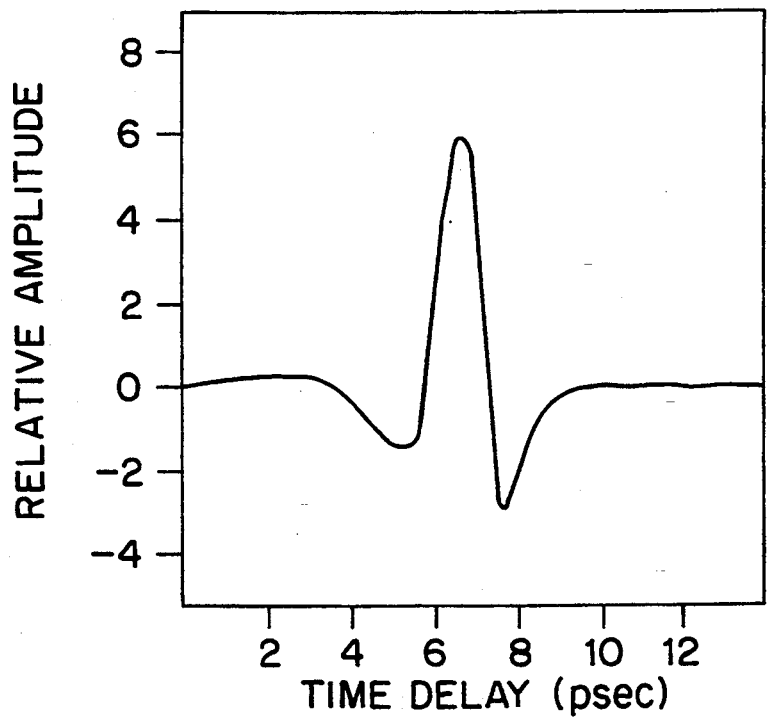
FIG. 3 is a graphic representation of a pulse of microwave electromagnetic radiation emitted from a photoconductor surface in a device in accordance with FIGS. 1 and 2.

FIG. 3 shows the waveform of the output of the dipole probe in response to a pulse of microwave electromagnetic radiation emitted from an indium phosphide planar photoconductor surface 18, with electrodes 12 and 13 spaced approximately 10 millimeters apart, and with a bias voltage of approximately 2000 volts. This waveform was measured in the far field, using a fused silica lens with a focal length of 5 centimeters to focus the electromagnetic pulse onto the dipole detector. The detector was aligned in the direction of the emitted radiation.

Below a bias field saturation strength, the electric field strength of the microwave radiation pulses was found to be essentially linearly dependent on the strength of the bias field, and on the optical radiation power. Although the waveform of FIG. 3 was strongly influenced by the response characteristics of the dipole probe and does not accurately represent the true waveform of a microwave radiation pulse emitted from the photoconductor 11, it nevertheless furnishes representative information concerning the peak electric field strength and duration of the microwave radiation pulse.

To determine the divergence of the emitted microwave electromagnetic radiation pulse beam, the electric field of the beam was also probed in the transverse direction. This was done by scanning the dipole probe in the far field of the device and determining the peak amplitude of the radiated signal waveform at each angle. For the backward beam 17, a maximum peak pulse amplitude was observed at an angle corresponding to the angle of specular reflection of the optical radiation pulse beam 15. The angular width of the microwave radiation pulse-beam 17 was found to be approximately 6 degrees at the 3-dB points.

Figure 2:
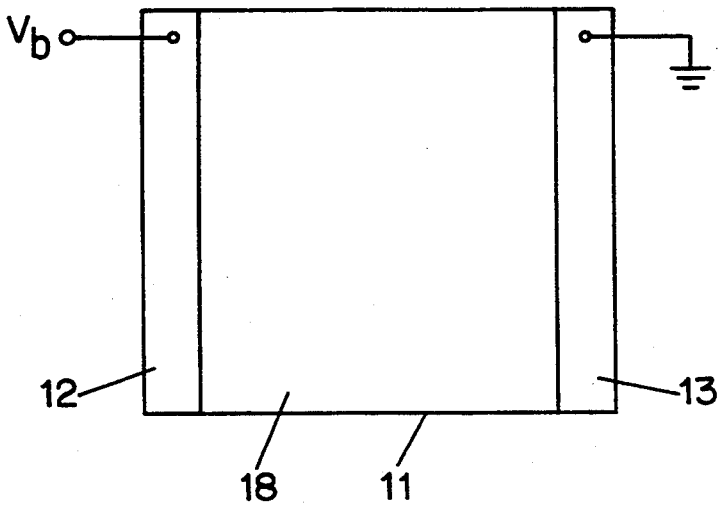
FIG. 2 is a schematic top view of a device in accordance with FIG. 1.

A further investigation was directed to power scaling and saturation properties of a large-aperture photoconductor emitter of the invention. Specifically, the optical radiation pulses 15 were produced by a balanced colliding-pulse, mode-locked ring dye laser and amplified by a laser amplifier pumped by a copper vapor laser. The resulting optical radiation pulse had an energy of several microjoules, a repetition rate of approximately 8 kilohertz, a pulse duration of approximately 70 femtoseconds, and a center wavelength of approximately 625 nanometers. The photoconductor source of FIGS. 1 and 2 with a gallium arsenide wafer as the photoconductor 11 and a spacing of approximately 1 millimeter between electrodes 12 and 13 was irradiated with these pulses, while a 200-volt bias voltage was applied between the electrodes. An emitted microwave electromagnetic radiation pulse beam was sensed with a 0.5-millimeter-gap radiation-damaged silicon-on-sapphire photoconducting probe at a distance of approximately 10 millimeters from the major surface 18. With increasing optical radiation pulse energy the peak strength of the electric field of the microwave radiation pulses increased until, at an optical radiation energy flux of approximately 400 microjoules/cm$^2$, the peak electric field strength of the microwave radiation pulses saturated at approximately 1750 volts/cm, which is close to the 2000 volts/cm static electric field between electrodes 12 and 13.

Similar saturation properties were observed in identical experiments using indium phosphide and cadmium telluride as the photoconductor 11.

It is estimated that, with appropriate power scaling, microwave electromagnetic pulses may be produced with a peak power near 1 gigawatt, and with peak electric fields greater than 10 megavolts/cm. Submillimeter waves having such fields may be of interest in the study of nonlinear properties of dielectric materials.

While these experiments were carried out with optical radiation pulses incident between electrodes 12 and 13 on a photoconductor surface 18, it will be understood that other modes of excitation may be used, e.g., quasi-continuous optical excitation by a light beam which is intensity-modulated at a desired frequency of output radiation. Further variations in the operation and design of a device include the use of focused or of divergent light to produce focused or divergent microwave electromagnetic radiation, the use of non-parallel, e.g., curved, electrodes, and the use of nonplanar photoconductor surfaces.

Figure 4:
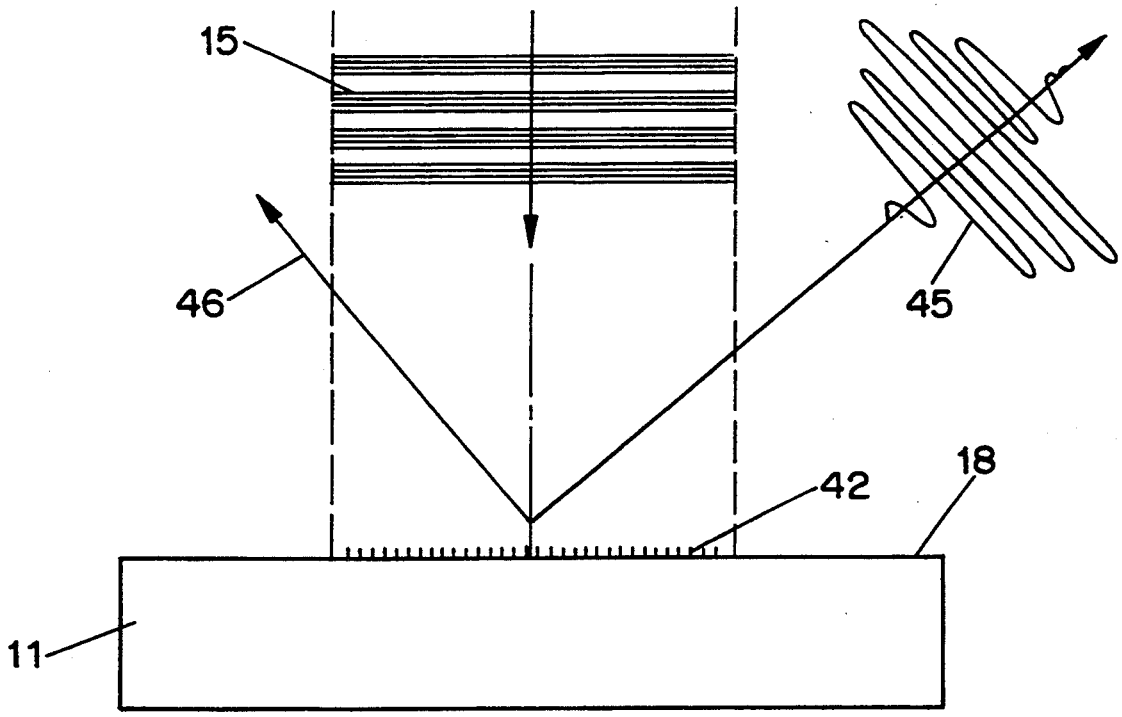
FIG. 4 is a schematic cross section of a microwave electromagnetic radiation source in accordance with another preferred embodiment of the invention, comprising a photoconductor having a multiplicity of regularly-spaced, linearly disposed electrodes formed on a surface thereof which is illuminated with a beam of optical radiation pulses.
Figure 5:
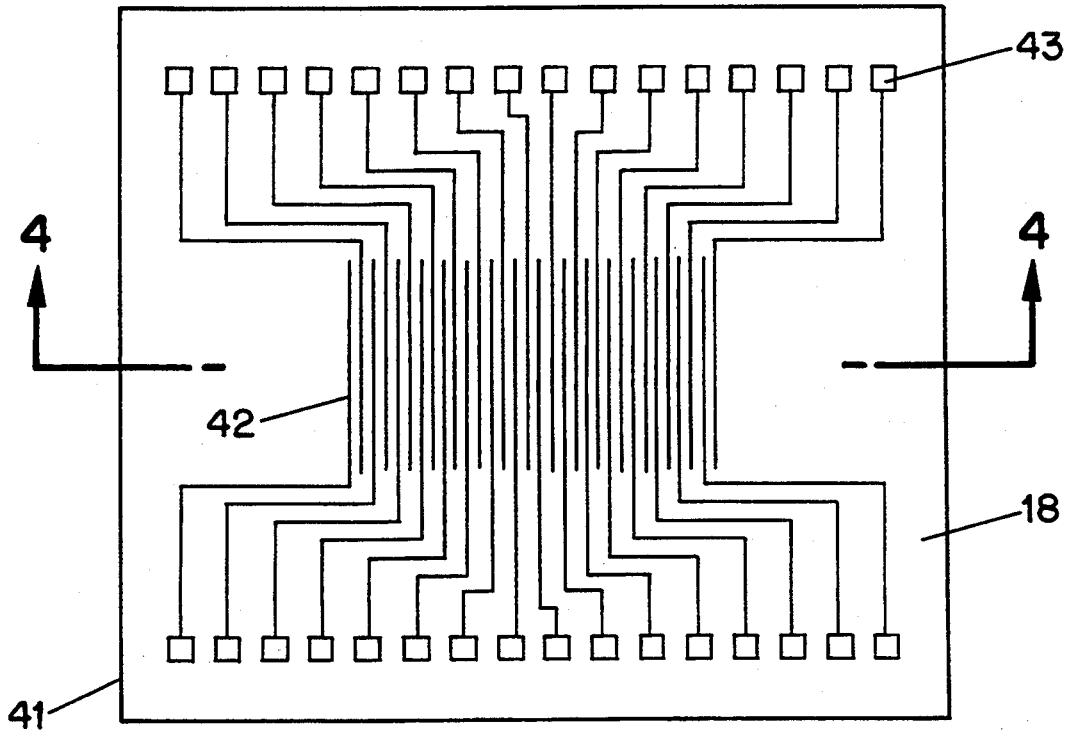
FIG. 5 is a schematic top view of a device in accordance with FIG. 4.

FIGS. 4 and 5 show a second preferred embodiment including an array of strip-like electrodes 42 linearly disposed along a particular direction on the major surface 18 of photoconductor 11. These electrodes can be independently biased via contact pads 43, so that the electric field between adjacent electrodes can controlled. When optical radiation pulses 15 illuminates the major surface 18 in the region of the electrodes 42 and appropriate bias voltages are applied to the contact pads 43 to establish respective electric fields in the surface regions between adjacent electrodes, transient photocurrents are generated beneath such surface regions and a microwave radiation pulse 45, which comprises the superposition of the microwave radiation from the separately driven transient photocurrents in such surface regions, is obtained.

In an experiment, 32 parallel electrodes, each 2 millimeters long and 25 micrometers wide, were formed photolithographically on a semi-insulating gallium arsenide substrate. Electrode spacing was 100 microns center-to-center. The electrodes were biased via slide potentiometers so as to produce a spatially sinusoidal and temporarily static bias voltage pattern across the electrode array 42. To ensure constant-amplitude output radiation, the bias voltages were scaled so that the maximum electric field between adjacent electrodes was maintained at a constant 1.25 kilovolts per centimeter.

For optical illumination, a train of four optical pulses with 2-picosecond spacing was used to produce a microwave electromagnetic radiation pulse having a frequency spectrum which peaked at approximately 500 gigahertz. A dual-jet, hybrid mode-locked dye laser, synchronously pumped at 78 megahertz by a frequency-doubled YLF laser generated optical radiation pulses at 640 nanometers with a duration of approximately 150 femtoseconds. The optical radiation pulse beam was unfocused, with a Gaussian profile 3 millimeters wide (i.e., the 1/e width), and with an average power of 130 milliwatts. Delayed pulses having equal intensity were generated by passing a single optical pulse through two calcite crystals having respective birefringent delays of two and four picoseconds.

Figure 6:
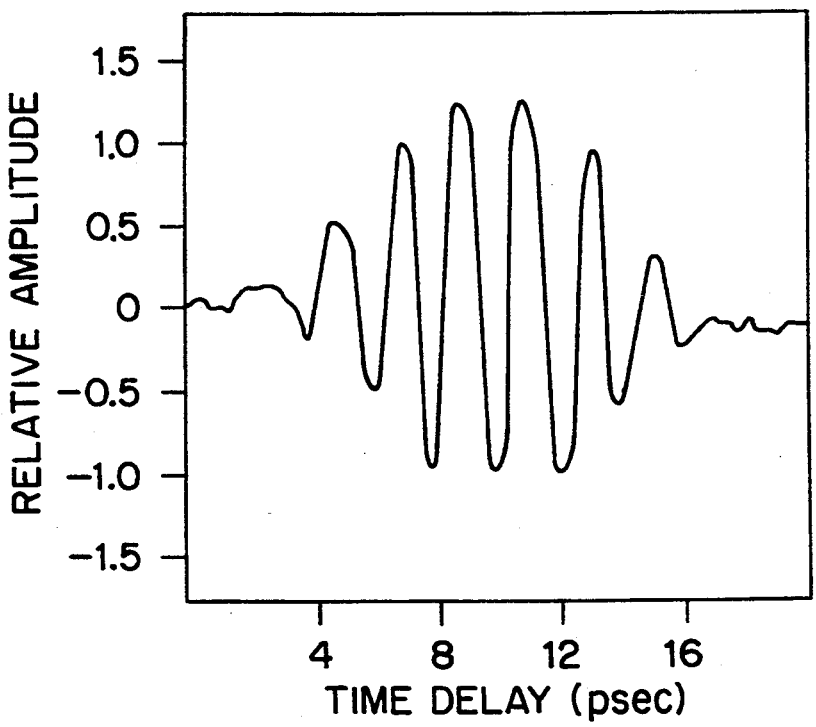
FIG. 6 is a graphic representation of a pulse of microwave electromagnetic radiation emitted from a photoconductor surface by a device in accordance with FIGS. 4 and 5.

The peak electric field strength of emitted microwave electromagnetic radiation pulses were sensed with a photoconducting dipole probe as described above. The gated output current from the probe was recorded while the relative time delay between the optical radiation pulses which illuminated the photoconductor surface 18, and the probe pulses which gated the detector was varied. As mentioned above, the probe pulses were derived by diverting a portion of the output of the laser with a beam splitter and directing the diverted laser pulses towards the photoconductor probe through a variable-length optical path which provided the required delay. FIG. 6 shows an output waveform from the probe in response to the microwave radiation sensed at an angle of 45 degrees with respect to the normal of the photoconductor surface 18, a distance of 3 centimeters from the electrode array 42 on the photoconductor surface 18, and with the period of the spatially sinusoidal bias voltage applied to the electrodes 42 adjusted to 0.9 millimeter. The divergence of the output beam at the 3-dB point was approximately 10 degrees. This beam divergence is determined by the aperture of the emitter of the microwave electromagnetic radiation, which for the embodiments of FIGS. 4 and 5 is the region of the major surface 18 having the electrode array 42 and illuminated by the optical radiation pulses 15 (here, 3.2 millimeters). The beam divergence would be smaller for a larger aperture.

The embodiments of FIGS. 4 and 5 afford steering of the microwave electromagnetic radiation pulse beam in a predetermined direction (i.e., the direction of the alignment of the electrodes 42) by purely electrical means, as the directions of the backward beam 45 and the forward beam (not shown) of microwave electromagnetic radiation pulses emitted from the photoconductor 11 depend on the period of the spatially periodic bias voltage pattern on the electrode 42.

To test the steerable property of the array, the dipole probe was kept fixed at an appropriate position of 45 degrees with respect to the normal of the major surface 18, and the period of the spatially sinusoidal voltage bias applied to the electrodes 42 was varied, while maintaining a constant maximum electric field. The microwave electromagnetic radiation pulse beam 45 was found to sweep past the stationary dipole probe, and a pronounced signal-strength maximum was obtained for the above-mentioned bias period of 0.9 millimeter.

Measurements were also made using a single optical pulse instead of a train of pulses for illumination. In this case the microwave electromagnetic radiation beam was found to be not as well collimated as in the four-pulse case. Also, owing to the strong frequency dependence of the superposition of the microwave radiation from the transient currents in the surface regions between adjacent electrodes to form the microwave electromagnetic radiation pulse 45, the spectrum of the emitted beam 45 varied strongly with angle across the beam.

For perpendicularly incident optical radiation pulses 15, as shown in FIG. 4 two output beams 45 and 46 are produced at equal angles from the perpendicular direction. However, as in the preferred first embodiment of the invention, it is possible to use oblique light incidence and to thereby achieve steering of one of the output beams 45 and 46 further off-axis (with respect to the incident beam) or even suppressing it.

Another variation involves the use, for optical input, of two quasi-continuous optical pulses with carrier frequencies separated by a microwave frequency as in optical heterodyning experiments. Further variations include the use of focused or of divergent light to produce focused or divergent electromagnetic radiation, the use of a nonplanar photoconductor surface, and the use of electrodes 42 which are non-parallel, unequally spaced, having more than one dimension or having shapes other than linear strips, e.g., semicircular or circular electrodes.

To achieve steering of the microwave electromagnetic radiation pulse beams 45 and 46 with two degrees of freedom, electrodes may be arranged in the form of a 2-dimensional array of squares, rectangles, parallelograms, or other suitable shapes, and adapted for the application of bias voltages patterns which are spatially periodic in two directions (e.g., x- and y-directions.) Finally, for many applications, frequencies may be preferred which are lower or higher than the 500 gigahertz frequency spectrum peak of the emitted microwave electromagnetic radiation of the experiments, and the power of the emitted radiation can be increased significantly by increasing the optical power, the bias voltage, and the size of the aperture.

Figure 7:
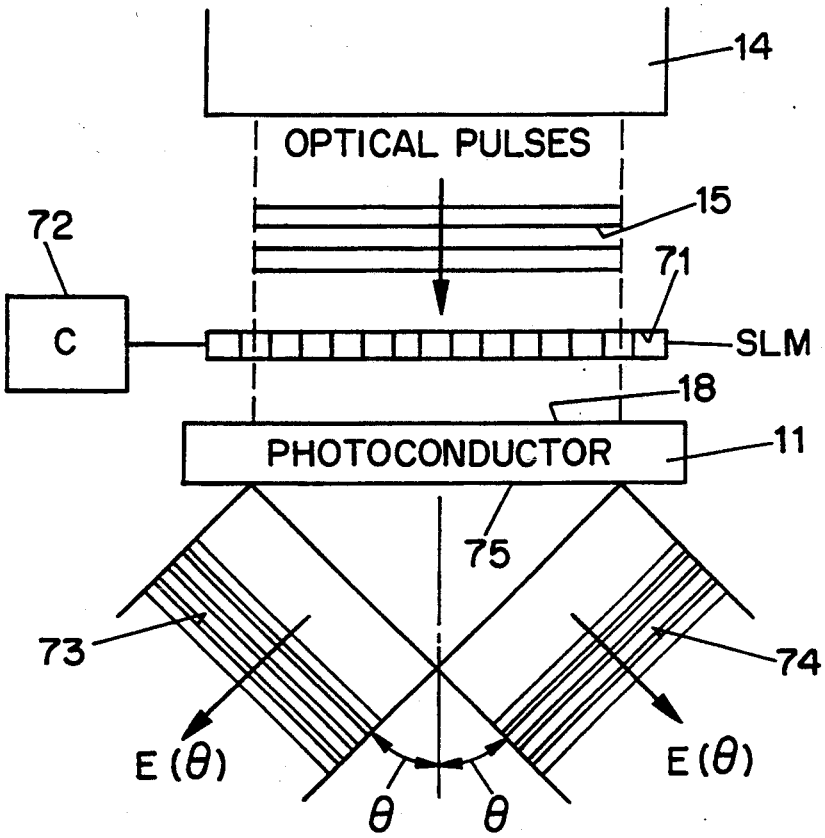
FIG. 7 is a schematic elevation of a microwave electromagnetic radiation pulse source in accordance with yet another preferred embodiment of the invention, including means for modulating the intensity of a beam of optical radiation pulses incident on a photoconductor surface.

Referring now to FIG. 7, there is shown a steerable-beam microwave electromagnetic radiation pulse source in accordance with still a further embodiment of the present invention. A photoconductor wafer 11 having opposing major surfaces 18 and 75. The major surface 18 is illuminated by a train of optical radiation pulses 15 emitted by an optical radiation source 14. As explained above, each of the optical radiation pulses 15 generates electron-hole pairs in the photoconductor 11 beneath the major surface 18, and such electron-hole pairs are driven in opposite directions by a static electric field adjacent the major surface 18 to produce transient photocurrents having a rise time on the order of the duration of the laser pulses, and a fall time comparable with the transit time of the free carriers across the region of the static electric surface field or the lifetime of the free carriers, whichever is shorter. These transient photocurrents each radiate a microwave electromagnetic radiation pulse a dipole pattern with main lobes perpendicular to the direction of the transient photocurrent. In the present embodiment the static electric surface field is perpendicular to the illuminated major surface 18. Such a surface field may be the naturally occurring depletion field at the surface of a semiconductive photoconductor material, such as indium phosphide, or may be applied by external means, such as appropriate electrodes (not shown) on the opposing major surfaces 18 and 75 and a dc bias voltage applied to such electrodes.

In the far field the superposition of the microwave electromagnetic radiation pulses radiated by the transient photocurrents form directional beams of microwave radiation pulses, each beam having an electric field intensity proportional to the first time derivative of the photocurrents. If the total illuminated area (i.e., the aperture) is greater in diameter than the wavelength of the peak of the frequency spectrum of the microwave electromagnetic radiation beam, each beam is collimated to a divergence which is diffraction-limited.

When a spatial light modulator (SLM) 71 is placed in the path of the optical radiation pulses 15 to produce a spatial intensity variation in the optical radiation illuminating the major surface 18, photocurrents generated in the photoconductor 11 are likewise spatially modulated. If the spatial modulation of the optical radiation pulses is periodic and the repetition rate of the optical radiation pulses is comparable to the inverse of the period of the spatial modulation of the optical radiation pulses 15, the microwave radiation field from the transient photocurrents in the periodically illuminated surface regions reconstructs into coherent collimated beams of microwave electromagnetic radiation in the far field. The direction of each beam is dependent upon the period of the spatial modulation of the optical radiation pulses 15. Consequently, the beams of microwave electromagnetic radiation pulses emitted from the photoconductor 11 may be steered by varying the period of the spatial modulation of the intensity of the optical radiation pulses illuminating the photoconductor surface 18, for example by applying appropriate control signals to the spatial light modulator 71 through control means 72.

If the direction of incidence of the optical radiation pulses 15 (with or without spatial modulation) is perpendicular to the photoconductor surface 18, the photoconductor 11 emits four first-order microwave electromagnetic radiation beams, two from each of the two opposing surfaces 18 and 75 of the photoconductor wafer 11, with the forward and backward beams being at equal angles from the respective normal of the photoconductor surfaces 18 and 75. For simplicity of depiction, only the two-forward beams 73 and 74 are shown in FIG. 7, and the backward beams have been omitted from the figure. As explained above, if the optical radiation pulses 15 incident on the photoconductor surface 18 have a periodic spatial intensity modulation, the angle $\theta$ between each of the forward beams 73 and 74 and the normal of the photoconductor surface 75 is dependent on the period of the spatial intensity modulation of the optical radiation pulses 15. The same is true for the angle between each of the backward beams (not shown) and the normal of the photoconductor surface 18.

Since there is no radiation in the direction of the transient photocurrents, which are driven by a surface field perpendicular to the photoconductor surface 18, there are no zeroth-order microwave radiation beams along the normal directions of the surfaces 18 and 75. In order to avoid zeroth-order microwave radiation beams in the forward and backward directions, it is preferred that the optical radiation pulse beam illuminating the photoconductor surface 18 is perpendicular to the surface.

Figure 8:
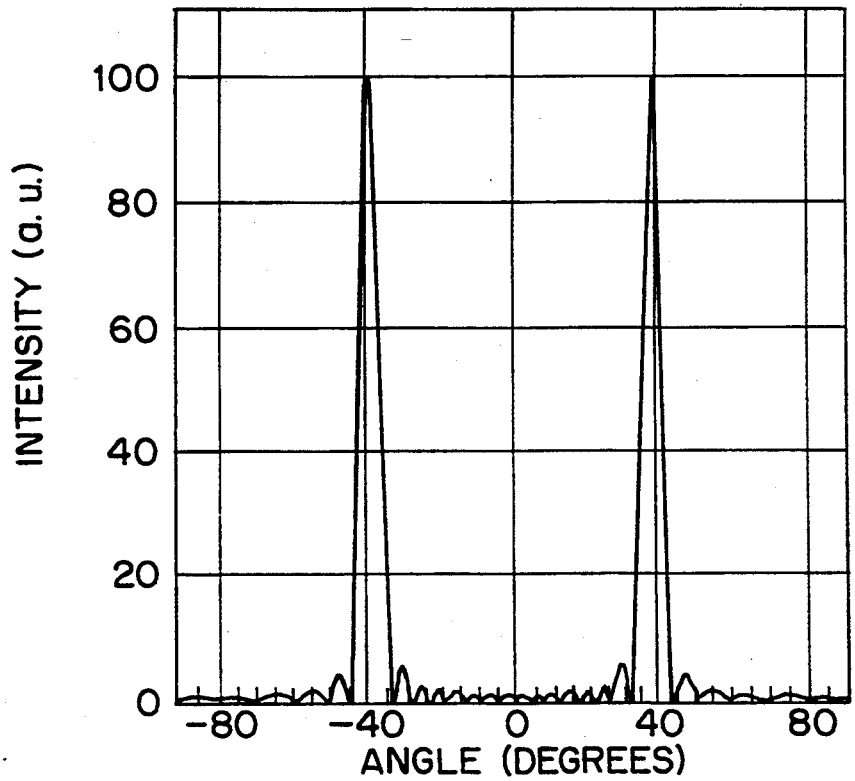
FIG. 8 is a graphic representation of the angular dependence of the intensity of a beam of microwave electromagnetic radiation pulses emitted from a photoconductor surface in response to illumination of the surface by a beam of optical radiation pulses with periodic spatial intensity modulation, the angular dependence being relative to the normal direction of the photoconductor surface.

The radiation intensities of the microwave electromagnetic radiation pulse beams emitted from the photoconductor wafer 11 were computed as a function of the emitting angle when the photoconductor surface 18 is illuminated by normally incident optical radiation pulses 15, which are spatially modulated such that the light intensity varied sinusoidally from a maximum value to zero intensity. For the computation the period of the sinusoidal spatial modulation of the optical radiation was assumed to be 0.1 millimeter, and the region of the photoconductor surface 18 illuminated by the optical radiation was assumed to extend over 32 spatial modulation periods (i.e., encompassing 32 peaks in the light intensity). Furthermore, it was assumed that the wavelength at the peak of the frequency spectrum of the emitted microwave electromagnetic radiation was 0.5 millimeter. The computed intensity of an emitted beam of microwave electromagnetic radiation as a function of the angle of the beam relative to the normal of the surface from which the beam was emitted is shown in FIG. 8.

Figure 9:
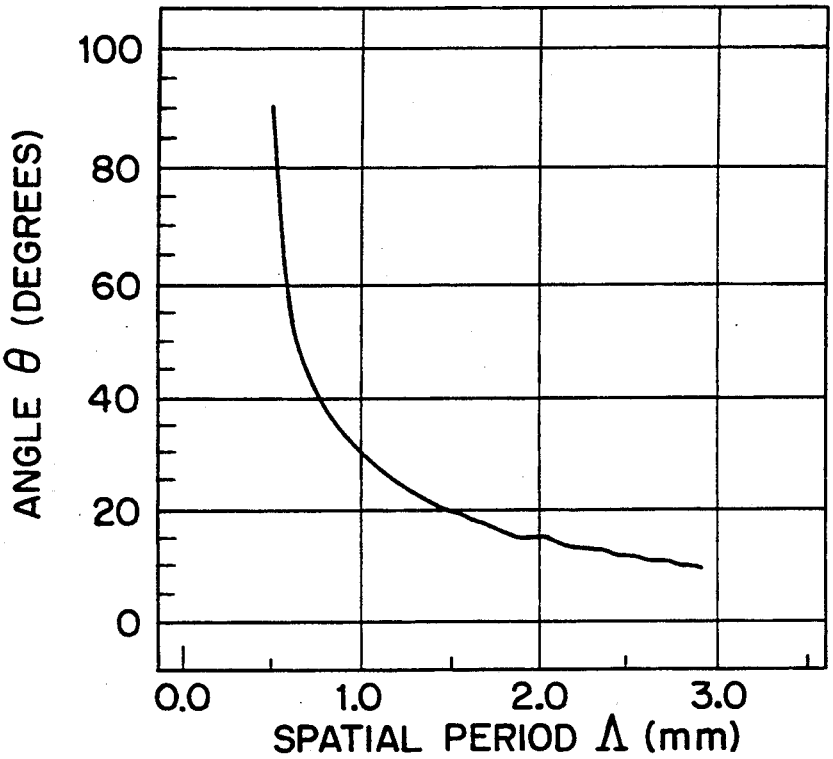
FIG. 9 is a graphic representation of the angular dependence of a beam of microwave electromagnetic radiation pulses emitted from a photoconductor surface as a function of the period, Ω, of the spatial modulation of the optical radiation incident on the surface, the angular dependence being relative to the normal direction of the photoconductor surface.

The angle of an emitted microwave electromagnetic radiation beam with respect to the normal of the surface from which the beam was emitted was also computed using the same assumed values of peak light intensity, extent of the illuminated region of the photoconductor surface 18 and the wavelength of the peak of the frequency spectrum of the emitted microwave radiation given above. The result of the computation is shown in FIG. 9. It can be seen from FIG. 9 that, as the period of the spatial modulation decreases, the angle of each emitted microwave electromagnetic radiation pulse beam relative to the normal of the surface from which the beam is emitted increases and approaches 90° as the period becomes comparable with the wavelength of the peak of the frequency spectrum of the microwave radiation pulses of the beam. Any further decrease of the spatial modulation period below the wavelength of the peak of the frequency spectrum of the emitted microwave electromagnetic radiation pulse beam results in the emission of higher-order beams and in reduced collimation of the emitted beams.

Figure 10:
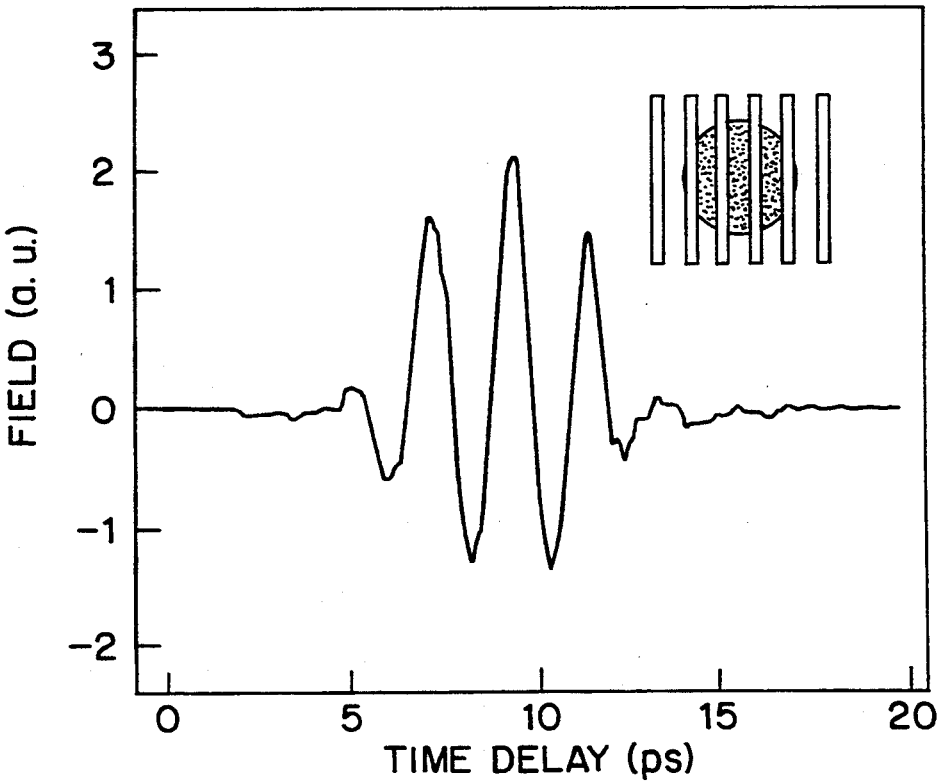
FIG. 10 is a graphic representation of a signal waveform of a microwave electromagnetic radiation pulse emitted from a photoconductor surface in an experiment with a device in accordance with FIG. 7.

In an experiment a semi-insulating indium phosphide wafer 11 was illuminated on a major surface 18 through an optical transmission grating 71 (2-millimeter Ronchi ruling) by normally incident optical radiation pulses 15 from a balanced, colliding-pulse, mode-locked (CPM) dye laser 14 producing 70-femtosecond pulses having a center wavelength of 615 nanometers and a pulse energy of 0.2 nanojoule at a repetition rate of 100 megahertz. A beam splitter (not shown) was used to split the output of the laser 14 into two beams with 40:60 power ratio. The stronger optical beam was used for illumination of the photoconductor surface 18 through the spatial light modulator 71 (i.e., the transmission grating) and was modulated by a mechanical chopper at a 2-kilohertz rate. The weaker optical beam was used for triggering a photoconducting dipole probe (not shown) and was passed through a variable length optical path which served as an adjustable delay. The photoconducting dipole probe (not shown) included a 100-micrometer-gap radiation-damaged silicon-on-sapphire dipole antenna at a distance of approximately 55 millimeters from the opposing surface 75 of the indium phosphide wafer 11 at an angle of approximately 30 degrees from the normal of that surface. The signal from the dipole probe was amplified by a lock-in amplifier, averaged and digitized. FIG. 10 shows the averaged signal waveform from the dipole probe and, in an inset, a representation of the transmission grating in the form of regularly-spaced alternating opaque and transparent bands (i.e., the spatial light modulator) superimposed on a circular cross section of the optical radiation beam to illustrate the periodically spatially modulated pattern of pulsed optical radiation illuminating the photoconductor surface 18. The waveform of FIG. 10 shows a series of time delayed microwave electromagnetic radiation pulses emitted by the surface regions of the photoconductor 11 beneath the bands of illumination.

One advantage of steering the emitted microwave electromagnetic radiation pulse beams by spatially modulating the optical radiation illuminating the photoconductor surface 18 is that the emitted microwave radiation beams (both the forward beams and the backward beams) may be steered in an azimuthal direction with respect to the normal of the surface from which the beams are emitted by rotating the spatial light modulator. Thus, steering of the emitted microwave radiation pulse beams with two degrees of freedom may be achieved. This was confirmed experimentally by rotating the transmission grating and observing the output signal from the photoconducting dipole probe as the beams are steered past the stationary probe.

While the above-described experiment used a transmission grating as the spatial light modulator 11 providing a fixed periodic spatial intensity modulation of the optical radiation pulses 15, it is recognized that an electrically-addressable, multi-element liquid crystal optical modulator may be used in conjunction with appropriate control signals to provide periodic spatial modulation of the optical radiation with a variable period and/or direction of spatial modulation.

As explained above, in the present embodiment of the invention the surface electric field driving the transient photocurrents must be perpendicular to the photoconductor surface being illuminated. Where the photoconductor material is a semiconductor, the naturally occurring surface depletion field beneath the illuminated surface may be used to drive the transient photocurrents. Alternatively, an external electric field applied through appropriate electrodes, which permit the transmission of optical radiation and microwave radiation, on the two opposing surfaces of the wafer and an appropriate bias source connected to the electrodes. Where the photoconductor material is a superlattice, a naturally occurring piezoelectric field beneath a surface of appropriate crystallographic orientation e.g., <111>-oriented strain-layer superlattices (see X.-C. Zhang et al., *Applied Physics Letters*, Vol. 57 (1990), p. 753), may be used as the static electric field for driving transient photocurrents in a direction perpendicular to the illuminated photoconductor surface. Static electric fields for driving transient photocurrents in a direction perpendicular to the illuminated photoconductor surface may also be produced by forming a large area p-n junction or a Schottky barrier junction adjacent the illuminated photoconductor surface. Experiments carried out using a <111>-oriented superlattice of 20 periods of 250-Angstrom gallium antimonide layers interleaved with 400-Angstrom aluminum antimonide layers as the photoconductor material produced results comparable to those obtained using indium phosphide. Similar results were obtained with polysilicon p-n junction solar cells. It is understood that these considerations concerning sources of electrical field in the direction perpendicular to the illuminated photoconductor surface apply to the production of microwave electromagnetic radiation pulse beams from photoconductor surfaces in accordance with the invention, whether or not the optical radiation pulses illuminating the photoconductor surface is spatially modulated.

We claim:

1. A device for producing a collimated beam of microwave electromagnetic radiation pulses, comprising:

a photoconductor body having a major, substantially planar surface;

illumination means for illuminating at least a relatively large aperture portion of the major surface with a beam of optical radiation pulses, for producing the collimated beam from the photoconductor body in a direction at an angle to the plane of the major surface.

2. The device of claim 1, wherein the photoconductor body consists essentially of radiation-damaged silicon.

3. The device of claim 1, wherein the photoconductor body consists essentially of a compound-semiconductor material.

4. The device of claim 1, further comprising means for controlling the direction of incidence of the beam of optical radiation pulses onto the major surface, providing means for controlling the direction in which the collimated beam of microwave electromagnetic radiation pulses is emitted.

5. The device of claim 1, wherein the relatively large aperture portion of the major surface is essentially flat.

6. The device of claim 5, further comprising electrode means on the major surface for producing, upon application of a d.c. voltage, a static electric field in a direction parallel to the relatively large aperture portion of the major surface.

7. The device of claim 6, wherein the electrode means consists of two electrodes which are spaced apart a distance which is greater than the spatial duration of an optical radiation pulse.

8. The device of claim 6, wherein the electrode means comprises an array of electrodes.

9. The device of claim 8, wherein the array of electrodes comprises linear strip electrodes.

10. The device of claim 9, further comprising electrical biasing means for applying voltages to the electrode means so as to form an essentially sinusoidal pattern of voltages.

11. The device of claim 1, wherein the illumination means includes spatial modulation means for spatially modulating the intensity of the optical radiation pulses, and wherein the direction of the beam of microwave electromagnetic radiation produced by the device relative to the direction of the beam of optical radiation pulses depends on the spatial modulation of the intensity of the optical radiation pulses.

12. The device of claim 11, wherein the spatial modulation of the intensity of the optical radiation pulses is periodic in a direction parallel to the major surface of the photoconductor body, and the direction of the beam of microwave electromagnetic radiation pulses produced by the device relative to the direction of the beam of optical radiation pulses depends on the period and the direction of the periodic spatial modulation of the intensity of the optical radiation pulses.

13. The device of claim 11, wherein the beam of optical radiation pulses is incident on the major surface of the photoconductor body in a direction perpendicular to the major surface.

14. The device of claim 12, wherein the spatial modulation means of the illumination means comprises a transmission grating through which the beam of optical radiation pulses pass prior to illuminating the major surface of the photoconductor body.

15. The device of claim 14, wherein the beam of microwave electrical magnetic radiation pulses produced by the device is steered by rotating the transmission grating to change the direction of the periodic spatial modulation of the intensity of the beam of optical radiation pulses illuminating the major surface of the photoconductor body.

16. The device of claim 11, wherein the spatial modulation means comprises an electrically-controllable liquid crystal modulator through which the beam of optical radiation pulses pass prior to illuminating the major surface of the photoconductor body, and means for providing control signals to the liquid crystal modulator for controlling the spatial modulation of the intensity of the beam of optical radiation pulses passing therethrough.

17. The device of claim 16, wherein the spatial intensity modulation of the beam of optical radiation pulses after passing through the liquid crystal modulator is periodic in a direction parallel to the major surface of the photoconductor body, and the direction of the beam of microwave electromagnetic radiation pulses produced by the device relative to the direction of the beam of optical radiation pulses depends on the period and the direction of the periodic spatial modulation of the intensity of the optical radiation pulses illuminating the major surface of the photoconductor body.

18. The device of claim 17, wherein the period of the periodic spatial modulation of the intensity of the optical radiation pulses is determined by the control signals provided by the control means, and the direction of the beam of microwave electromagnetic radiation pulses produced by the device relative to the direction of the beam of optical radiation pulse is changed by altering the control signals provided by the control means.

19. The device of claim 17, wherein the direction of the periodic spatial modulation of the intensity of the optical radiation pulses is determined by the control signals provided by the control means, and the beam of microwave electromagnetic radiation pulses produced by the device relative to the direction of the beam of optical radiation pulses is changed by altering the control signals provided by the control means.

20. The device of claim 11, wherein the illumination means includes laser means producing a repetitive sequence of optical radiation pulses each having a pulse duration of less than 1 picosecond.

21. The device of claim 20, wherein the laser means comprises a colliding-pulse, mode-locked laser.

22. The device of claim 11, wherein the photoconductor body comprises a semiconductive material having a surface depletion layer beneath the major surface, the depletion layer providing an electric field in the direction perpendicular to the major surface.

23. The device of claim 11, wherein the photoconductor body comprises a superlattice structure semiconductive material and the major surface of the photoconductor body has a crystallographic orientation in which there exists at the major surface a strain layer producing a piezoelectric field in a direction perpendicular to the major surface.

24. The device of claim 11, wherein the photoconductor body comprises a semiconductive material and there is formed adjacent the major surface a p-n junction extending over at least the relatively large aperture portion of the major surface.

25. The device of claim 11, wherein the photoconductor body comprises a semiconductive material and there is formed adjacent the major surface a Schottky barrier junction extending at least over the relatively large aperture portion of the major surface, the Schottky barrier junction being transparent to the beam of optical radiation pulses.

26. The device of claim 11, wherein the photoconductor body has first and second parallel major surfaces, the first major surface being illuminated by the illumination means, and there being formed on the first and second major surfaces respective electrode means which, when coupled to a voltage bias source, produce an electric field in a direction perpendicular to the first major surface, the respective electrode means formed on the first major surface passing the beam of optical radiation pulses illuminating the first major surface, and at least one of the respective electrode means formed on the first and second major surfaces, passing the beam of microwave electromagnetic radiation pulses produced by the device.

27. A method for producing a directional beam of microwave electromagnetic radiation pulses from a photoconductor body having a major, substantially planar surface, comprising the step of:

illuminating at least a relatively large aperture portion of the major surface with a beam of optical radiation pulses, to produce the directional beam from the photoconductor body with main direction at an angle to the plane of the major surface.

28. The method of claim 27, wherein the direction of microwave electromagnetic radiation pulses is controlled by controlling the direction of illumination.

29. The method of claim 27, wherein the direction of microwave electromagnetic radiation pulses is controlled by controlling biasing voltages applied to electrodes on the photoconductor body.

30. The method of claim 29, wherein the biasing voltages form an essentially sinusoidal pattern.

31. The method of claim 27, wherein the intensity of the optical radiation pulses has a spatial modulation, and the direction of the beam of microwave electromagnetic radiation pulses relative to the direction of the beam of optical radiation pulses being dependent on the spatial modulation of the intensity of the optical radiation pulses.

32. The method of claim 31, wherein the spatial modulation of the intensity of the optical radiation pulses is periodic in a direction parallel to the major surface of the photoconductor body, and the direction of the beam of microwave electromagnetic radiation pulses relative to the direction of the beam of optical radiation pulses being dependent on the period and the direction of the periodic spatial modulation of the intensity of the optical radiation pulses.

33. The method of claim 32, wherein the step of illuminating the major surface comprises the steps of:

generating a beam of optical radiation pulses suitable for illuminating a relatively large aperture portion of the major surface of the photoconductor body; and spatially modulating the intensity of the beam of optical radiation pulses prior to illuminating the major surface of the photoconductor body therewith.

34. The method of claim 33, wherein the step of spatially modulating the beam of optical radiation pulses includes the step of changing the period of the spatial modulation of the intensity of the beam of optical radiation pulses to cause a change in the direction of the beam of microwave electromagnetic radiation pulses relative to the direction of the beam of optical radiation pulses.

35. The method of claim 33, wherein the step of spatially modulating the intensity of the beam of optical radiation pulses includes the step of changing the direction of the periodic modulation of the intensity of the beam of optical radiation pulses to cause a change in the direction of the beam of microwave electromagnetic radiation pulses relative to the direction of the beam of optical radiation pulses.

36. The method of claim 31, wherein the direction of the beam of optical radiation pulses illuminating the major surface of the semiconductor body is perpendicular to the major surface.

* * * * *